US006137887A

United States Patent [19]

Anderson

[11] Patent Number: 6,137,887

[45] Date of Patent: Oct. 24, 2000

[54] DIRECTIONAL MICROPHONE SYSTEM

[75] Inventor: Matthew G. Anderson, Libertyville, Ill.

[73] Assignee: Shure Incorporated, Evanston, Ill.

[21] Appl. No.: 08/931,032

[22] Filed: Sep. 16, 1997

[51] Int. Cl.[7] ..... H04R 25/00

[52] U.S. Cl. ..... 381/92; 381/81; 381/111; 381/356

[58] Field of Search ..... 381/81, 92, 103, 381/107, 122, 110, 356, 111, 358; 379/206

[56] References Cited

U.S. PATENT DOCUMENTS 4,489,442 12/1984 Anderson et al. ..... 381/81
4,658,425 4/1987 Julstrom ..... 381/81

OTHER PUBLICATIONS

"Direction–Sensitive Gating: A New Approach to Automatic Mixing," Stephen Julstrom and Thomas Tichy, *J. Audio Eng. Soc.*, vol. 32, No. 7/8 1984 Jul./Aug., presented at the 73rd Convention of the Audio Engineering Society, Eindhoven, The Netherlands, Mar. 15–18, 1983.

*Primary Examiner*—Huyen Le
*Attorney, Agent, or Firm*—Banner & Witcoff, Ltd.

[57] ABSTRACT

A multiple-microphone actuation control system using direction-sensitive microphones turns ON microphones only if a talker's speech originates from within a specified "acceptance angle" in front of the microphones. Additionally, the invention automatically identifies which microphone best "hears" the talker, and only turns ON one microphone per talker, while allowing several microphones to turn ON simultaneously for several talkers.

21 Claims, 5 Drawing Sheets

DIRECTIONAL MICROPHONE SYSTEM

BACKGROUND OF THE INVENTION

The present invention relates to automatic microphone control systems and, more particularly, to an enhancement of the invention disclosed in U.S. Pat. Nos. 4,489,442, issued to Carl R. Anderson, et al. entitled "Sound Actuated Microphone System" and 4,658,425, issued to Stephen D. Julstrom, entitled "Microphone Actuation Control System Suitable for Teleconference Systems." U.S. Pat. Nos. 4,489,442 and 4,658,425 are both owned by the same entity as the present application.

The contents of U.S. Pat. Nos. 4,489,442 and 4,658,425 are incorporated herein by reference, as if fully set forth below. For ease of reference, U.S. Pat. Nos. 4,489,442 is hereinafter referred to simply as the "Anderson patent"; 4,658,425 is hereinafter referred to as "the Julstrom patent".

It is a common practice in audio engineering to use multiple microphones placed at different locations throughout rooms such as conference rooms, classrooms, or on a stage wherein multiple talkers voices need to be either amplified and/or recorded. In such a system, the outputs of the microphones are usually added (combined) in an audio mixer, the output of which might feed into an amplifier, a recording device, or a transmission link to a remote location.

Multiple microphones are used to insure that each person's voice can be picked up by at least one microphone at a relatively close distance to his mouth thereby helping to insure that the audio quality, including intelligibility, is sufficient for each person. In a conference room, classroom, or on a stage, using only one microphone invariably means that some talkers will be farther away from the microphone than others. The talkers who are far from the microphone might not have their voices heard well above the rooms background noise. Using multiple microphones results in a higher ratio of direct sound from the talker's voice to room noise and reverberation at each microphone. However, the use of multiple microphones that all pick up the unwanted ambient noise and reverberation as well as the desired talker's voice creates several other problems.

The Anderson patent teaches a method and apparatus for determining if a given microphone should be turned ON or OFF by using two, back-to-back cardioid microphone elements. If a talker's voice originates from in front of the microphone, then the signal heard by the front-oriented microphone will be louder than the rear-oriented microphone, and the microphone should then be turned ON.

The output signal from a cardioid microphone element can be plotted in polar coordinates which will produce the heart-shaped graph shown in FIG. 3 of the Anderson patent. A sound wave incident upon a cardioid microphone element at an angle theta, will have an output level represented by the vector "S". FIG. 3 is a polar coordinate plot of the cardioid element as a function of the angle of incidence of an acoustic wave. A wave that impinges upon the element at 0 degrees will produce the highest possible output; a wave that impinges upon the rear of the element, i.e. at 180 degrees, in theory, produces no output. The combination of the polar responses of the elements with the circuitry described in the Anderson patent yields a direction-sensitive microphone which will turn ON if a sound originates within a predetermined angle in front of the microphone; it is spatially selective.

While the invention disclosed in the Anderson patent is effective in providing spatial selection of microphones, such spatial selection is often insufficient to avoid unwanted detection of an audio source. When several microphones are placed side-by-side, the spatial selectivity of the microphones is inadequate to avoid turning ON several of the microphones if a sound source originates within the sound-sensitive space of more than one of the microphones.

In applications where multiple microphones are required to be able to hear different talkers, it would be desirable to be able to ignore microphones that do not best "hear" the talker's voice.

While the Julstrom patent disclosed a circuit for comparing the outputs of several microphones in an audio sound system and for turning ON only one microphone per talker, the Julstrom patent does not provide any means for spatial selection of microphones; a talker can turn ON a microphone if he is not in front of it.

Accordingly, an audio system that discriminates both on the number of ON microphones per talker and the location or orientation of the source would be an improvement over the prior art.

An object of the present invention is to provide an audio system that identifies if a talker is within some predetermined location with respect to the microphone and identifies the microphone that best hears the talker.

SUMMARY OF THE INVENTION

There is provided an improved multiple-microphone audio system that identifies which microphone of a plurality of microphones best detects an audio source. The system employs multiple unidirectional microphones per channel and associated circuitry to turn OFF a microphone channel for audio signals originating from sources outside a predetermined geometric angle formed by a normal to the microphone's sensing element. Additional signal processing evaluates output signal amplitudes from the other microphones and detects which microphone instantaneously has the largest output signal. The largest-signal determination is logically "AND"ed with the front-of-microphone signal amplitude test to identify the microphone that best "hears" a talker.

DESCRIPTION OF THE PREFERRED ELEMENT

Figure 1:
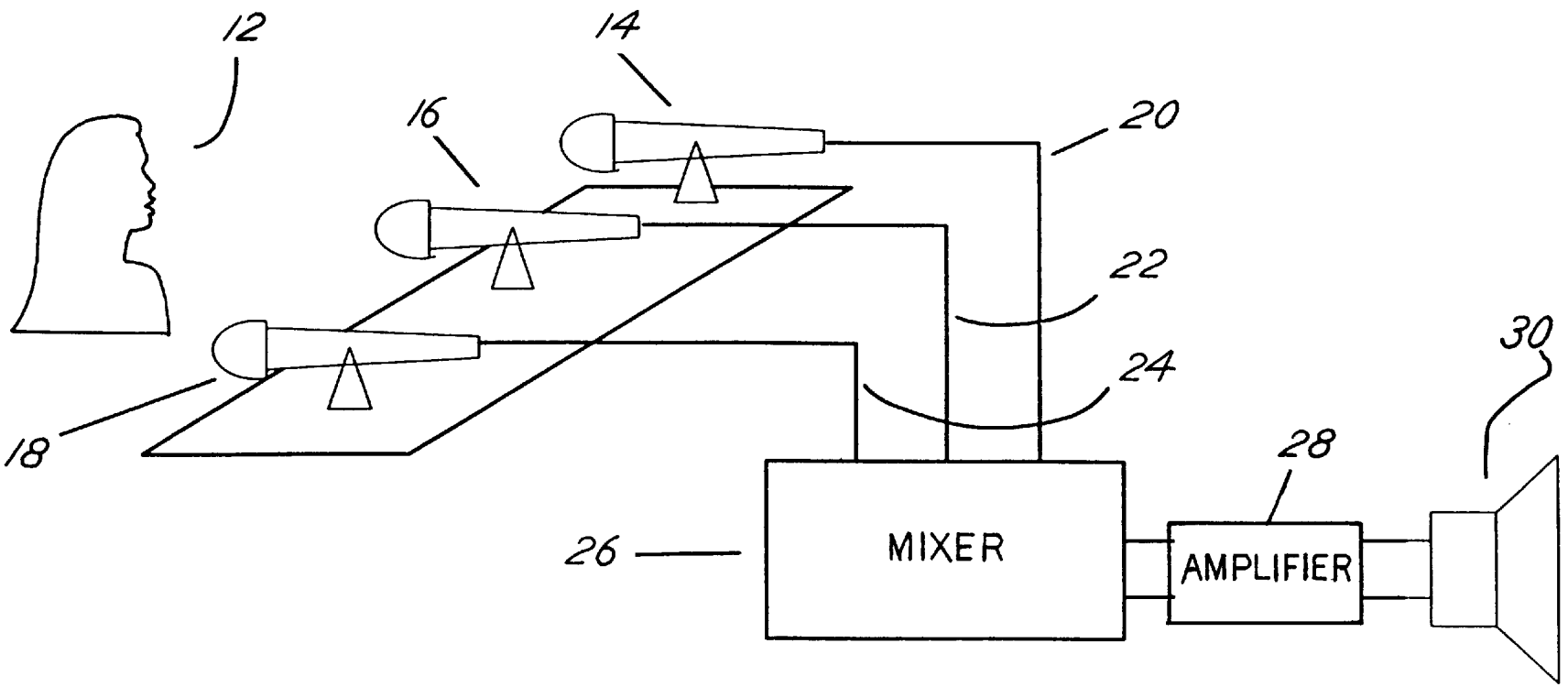
FIG. 1 shows a block diagram of a multiple-microphone audio system.

FIG. 1 shows a multiple-microphone sound system (10) contemplated by the embodiment described herein. A talker (12), whose voice is to be amplified or broadcast for other distribution, is generally in front of and within the acoustic detection range of three microphones (14, 16 and 18). As would occur in real experiences, the talker (12) is preferably proximate to at least one of the microphones (14, 16, and 18) but in reality all three microphones "hear" the talker's voice.

Outputs from the microphones (14, 16 and 18) are input (20, 22, and 24) to microphone mixer (26), which sums the inputs (20, 22 and 24). The mixer's output (27) feeds an amplifier (29) which drives a loudspeaker (30). While each of the microphones (14, 16, and 18) hear the talker (12), one of the microphones will always hear the talker better than the others. The microphone that is best located or positioned to detect the talker's voice, is preferably the only microphone that should be enabled; its output should be the only signal heard from the loudspeaker (30). The invention contemplated herein uses "direction-sensitive" microphones and audio signal amplitude discrimination circuitry to selectively amplify a talker's voice detected from the microphone that best "hears" the talker.

Direction-sensitive microphones are well-known and described in U.S. Pat. No. 4,489,442, the "Anderson patent." For ease of reference, FIG. 2A shows a simplified block diagram of a direction-sensitive microphone (50) and is prior art.

Figure 2A:
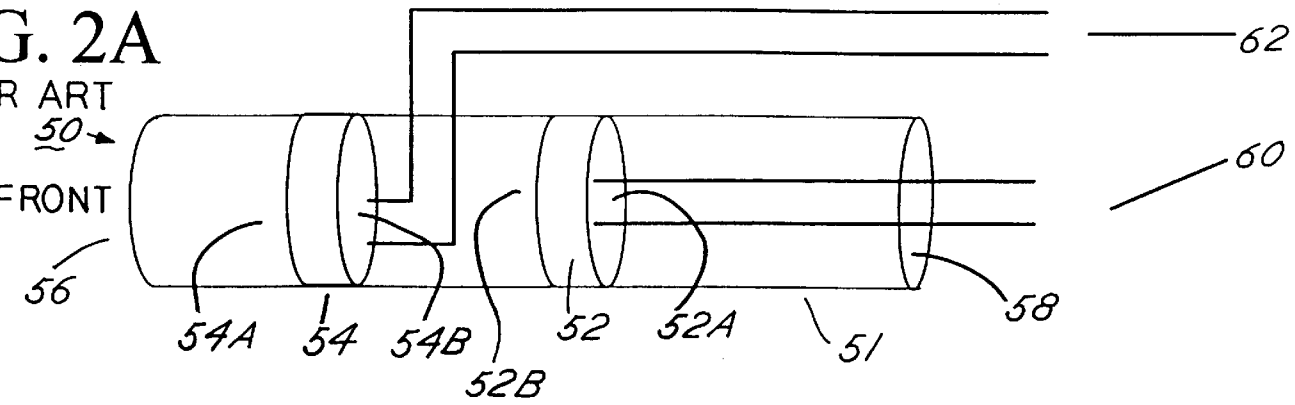
FIG. 2A PRIOR ART
FIG. 2A shows a simplified cross-sectional diagram of a unidirectional microphone employed in the preferred embodiment herein.

In the embodiment shown in FIG. 2A, and in the Anderson patent, a housing (51) which in the preferred embodiment is an elongated tube, has mounted within it a first cardioid directional microphone element (54) and a second cardioid directional microphone element (52).

It should be understood that the elongated tube (51) is constructed such that audio waves can readily pass through it. A wire or plastic mesh or screen might support the two microphone elements. In the preferred embodiment the tube (51) is constructed from columnar frame members that hold the two microphone elements with the orientations shown in FIG. 2A. The top and bottom outlines of the tube (51) shown in FIG. 2A depict placement of the columnar frame members that hold the directional microphone elements in place. The microphone elements might also be supported by a plurality of rigid or semi-rigid wires maintaining the orientation of the microphone elements inputs as shown. The front, or first, cardioid directional microphone elements (54) has a front audio, or acoustic, input port (54A) and a rear audio input port (54B). The rear, or second, directional microphone element (52) also has a front audio, or acoustic, input port (52A) and a rear input acoustic port (52B).

Figure 2B:
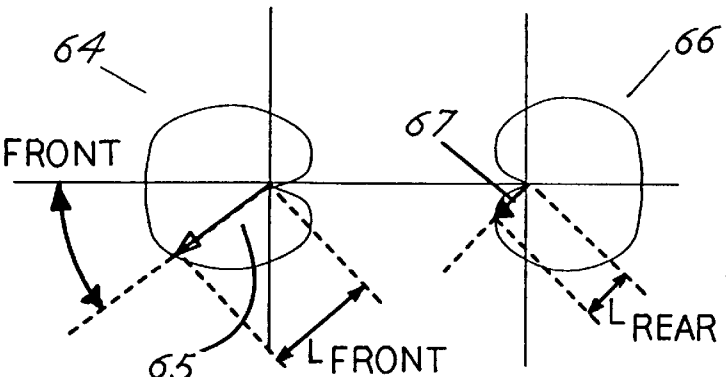
FIG. 2B PRIOR ART
FIG. 2B shows a simplified plot of the relative output level of the cardioid microphone elements used in the microphone shown in FIG. 2A as a function of an audio signal's angle of incidence upon the included microphone elements.

Again, with reference to the Anderson patent, FIG. 3 therein shows a polar coordinates plot of the relative output signal level from a cardioid microphone element as a function of an acoustic signal's angle of incidence upon the microphone. In FIG. 2B, the plot of the relative output amplitude of the first cardioid element (54) is identified by reference numeral 64; the plot of the relative output amplitude of the second cardioid element (52) is identified by reference numeral 66. As set forth in the Anderson patent, the cardioid elements (52 and 54) can be considered as directional elements in that their output signals are greatest when an audio wave is incident upon the front audio input port at an angle that is substantially normal to the plane of the front audio input port. The response of cardioid elements is well known and the polar coordinate plot shown in FIG. 2B is also prior art.

With reference to FIG. 2A, the first and second microphone elements (52 and 54) are mounted within the elongated tube (51) and are positioned such that the front audio input port (54A) of the first cardioid directional microphone element (54) faces or is oriented to one end of the tube (51) that can be considered to be the front (56) of the microphone (50). The opposite end of the tube (51) is considered the rear (58) of the direction-sensitive microphone (50).

As set forth in the Anderson patent, audio signals incident upon the front 56 end of the microphone (50) produce an output signal from the first microphone element (54) at its output terminals (62) that will be substantially greater than the amplitude of the signal output from the second microphone element (52) from its output terminals (60).

Figure 2C:
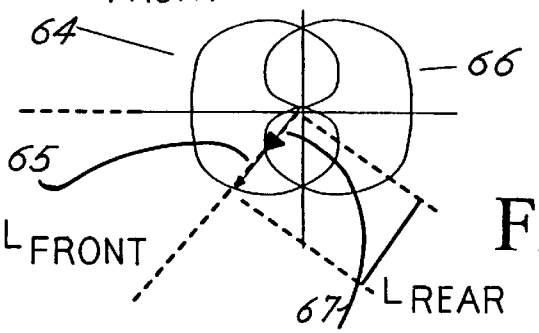
FIG. 2C shows the two plots shown in FIG. 2B overlaid to show the difference in output signal level from the front cardioid element versus the rear cardioid element.

FIG. 2B shows a polar plot of the output levels (64 and 66) produced by the front or first microphone element (54) and the rear or second microphone element (52) for a given angle of acoustic incidence, theta. Vector (65) has a length $L_{front}$ that represents the output level from the front microphone element (54). Vector (67) has a length $L_{rear}$ that represents the output level from the rear microphone element (52). FIG. 2C shows the superposition of the plots (64 and 66) and illustrates that for a sound source positioned at the angle theta, vector (65) $L_{front}$ is substantially greater than vector (67) $L_{rear}$. FIG. 2C is also disclosed in the aforementioned Anderson patent and is also prior art.

As set forth in the Anderson patent, when the angle of incidence theta is equal to approximately 60 degrees, the output level of the front microphone element (54) would be approximately 9.5 decibels greater than the output level of the rear microphone element (52).

It can be seen in FIG. 2A, that the first microphone element (54) and the second microphone element (52) are both directional microphone elements mounted within the substantially elongated housing (51) which, of course, has a center axis. The angle of incidence of audio signals is measured with respect to the center axis of the microphone elements, which in FIG. 2A is substantially the center axis of the tube (51). In alternate embodiments, the directional microphone elements (52 and 54) can be mounted in housings other than tubes, such as cubes, cones, or other geometrically shaped housings. The directional microphone elements are preferably collinear and kept proximate to each other so as to be able to accurately measure differences in audio signal amplitudes incident upon (heard by) both elements wherever they are placed in a room. In the preferred configuration, the rear audio input ports of the two microphone elements (54 and 52) are oriented such that they face each other in the elongated tube (51). The front audio input ports of both microphone elements (54 and 52) face the opposite ends of the tube (51) or other housing containing the elements.

The unidirectional microphone apparatus shown in FIG. 2A is commercially available from Shure Brothers Incorporated in their AMS line of microphones.

Of necessity, both microphone elements have output terminals (60 and 62) from which electrical signals are produced, the amplitudes of which represent the relative amplitude of an audio wave impinging upon and thereby detected by the microphone element (52 and 54). In the embodiment shown in FIG. 2A, the first microphone element (54) has output terminals identified by reference numeral (62). Reference numeral (60) identifies the output terminals of the second microphone element (52). In the preferred embodiment, these two sets of electrical output terminals share a common ground and have a signal level from each microphone element available on their own output line. Accordingly, there are three wires connected to the microphone (50).

The salient feature of the microphone contemplated by the invention herein is that when audio signals impinge upon the input port (56) of the front direction sensitive microphone element at an angle substantially greater than 60 degrees, the output from the front microphone is less than 9.5 decibels greater than the output from the rear (52) directional microphone element. This 9.5 dB signal differential is determined by subsequent audio signal processing circuitry to be the ratio at which the microphone's output is turned OFF. Stated alternatively, front-to-back microphone signal differences of less than 9.5 dB result in the audio signal not being amplified by the system. As will be seen in the description hereinafter, the 60 degree directional sensitivity is a design choice that is determined by the signal processing of the audio output signals from the first and second microphone elements (54 and 52) respectively. As such, the 60-degree cutoff is a predetermined amount of front-to-back signal differential.

The output signals from the directional microphone elements (54 and 52) appear at what can be considered front and rear output terminals (62 and 60) of the microphone (50). Signals from these output terminals are subsequently processed by circuitry to determine the difference in amplitude detected by the front and rear microphone elements (54 and 52).

Figure 3A:
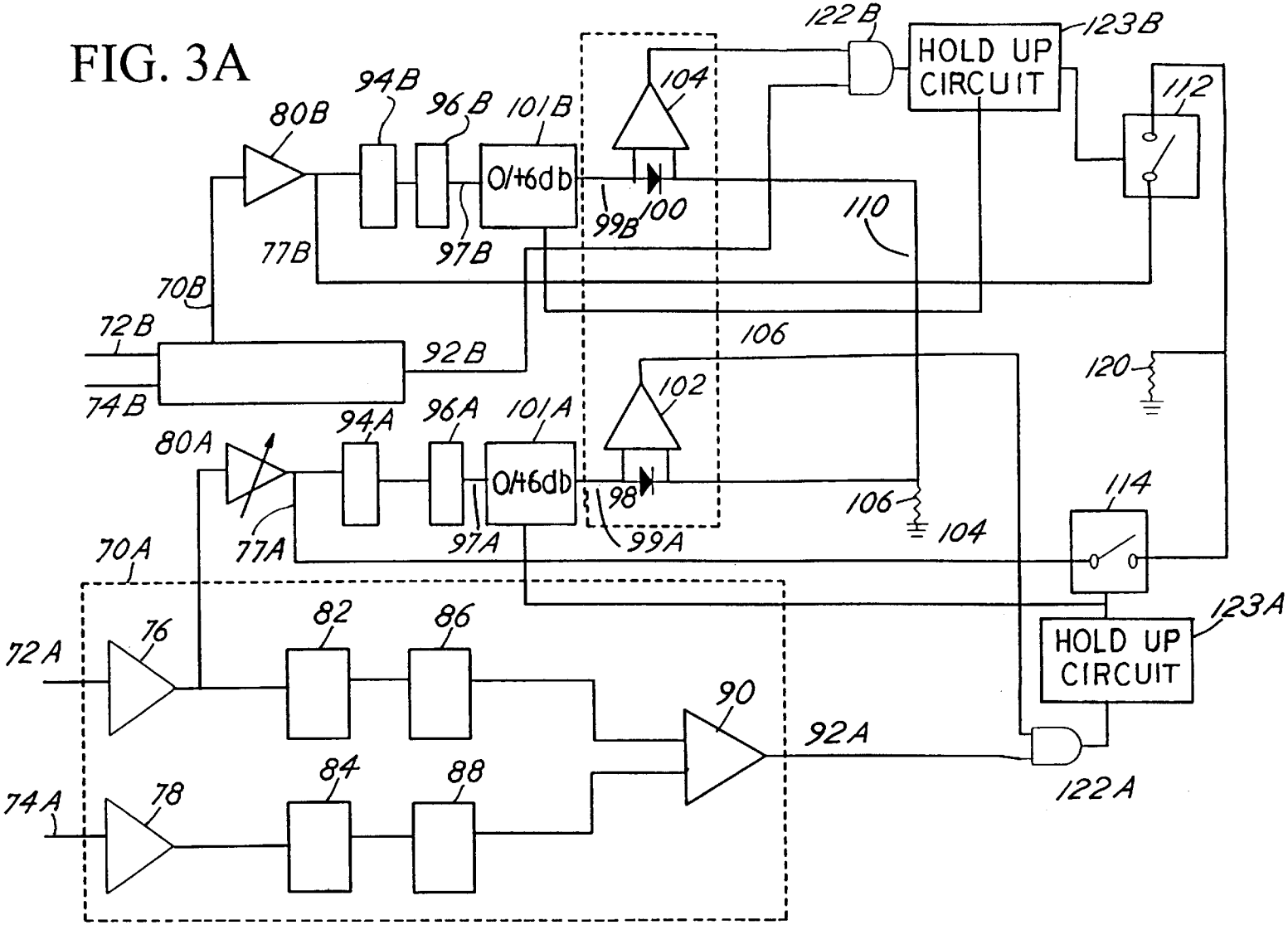
FIG. 3A shows a functional block diagram of the preferred embodiment of the invention.

FIG. 3A shows a functional block diagram of an audio signal processor that receives the front and rear output signals from the direction-sensitive microphone shown in FIG. 1 and depicted in FIG. 2A. This audio signal processor produces, as an output, audio signals detected by the microphone (50) when the audio signal level from the first or front directional microphone element exceeds the audio signal level detected by the rear, or second, microphone element by approximately 9.5 decibels. As set forth above, it has been determined, and is disclosed in the Anderson patent, that when audio signals are incident upon the microphone at an angle of 60 degrees, the front cardioid element will have an output signal that is approximately 9.5 decibels greater than the output level of the rear cardioid microphone element. The discrimination of the front microphone element against the rear microphone element is performed by the audio signal processing circuit (70A) shown in FIG. 3A.

Signal output from the cardioid microphones, front microphone element (54) and rear microphone element (52) are coupled into the audio signal processor (70A) at two inputs thereof (72A and 74A). In the embodiment shown in FIG. 3A, input (72A) receives signals from the front directional microphone (54) through its output terminals (62) (not shown in FIG. 3A). Audio signals from the rear directional microphone element (52) from its output terminals (60) are coupled into input (74A) of the audio signal processing circuit (70A).

Signals received at both inputs (72A and 74A) are preamplified (76 and 78) by equal amounts to increase the levels of the signals received from the microphone's front and rear cardioid elements to levels suitable for the subsequent circuitry. Output from pre-amplifier (76) is coupled to a gain fader stage (80) for additional signal processing as described further below.

Outputs from preamplifier stages (76 and 78) are then coupled into gain/bandpass equalization stages (82 and 84) which emphasize the speech-band frequencies from the microphone elements and further amplify the signals for subsequent circuitry. These equalized signals are fed to matching half-wave-logarithmic-rectifier and filter stages (86 and 88). The output of the half-wave-logarithmic-rectifier and filter stages (86 and 88) are substantially DC-level signals which do vary but which fairly represent the signal level amplitude output from the front and rear (54 and 52) cardioid microphone elements within microphone (50). The outputs of the half-wave-logarithmic-rectifier and filter stages (86 and 88), are compared (90) to determine whether or not the signal at the front cardioid element (54) exceeds audio detected at the rear cardioid element (52) by some predetermined amount, i.e. 9.5 dB in the preferred embodiment and to produce a direction-sensitive microphone control signal (92).

As a matter of design choice, the half-wave-logarithmic-rectifier and filter stages, (86 and 88), have one of their gain values adjusted. Alternatively the comparator 90, is designed such that its output goes true or active when the signal level input at input (72) exceeds that to input (74) by approximately 9.5 decibels.

The 9.5 dB differential is a design choice and reflects the signal level detected by the cardioid elements when an audio source is equal to 60 degrees divergence from a normal to the front microphone element (54). As set forth in the Anderson patent, this 9.5 dB differential is a function of the response of the cardioid microphone element and the trigger points selected by design of the audio signal processing circuitry (70A).

In effect, the audio signal processing circuit (70A) produces as an output, a signal (92) that goes true, or active, when the amplitude of the output from the first or front cardioid microphone element (54) exceeds the output from the rear or second cardioid element by a predetermined amount. In the preferred embodiment, this predetermined amount was determined to be 9.5 decibels. Alternate embodiments could, of course, contemplate a greater or smaller differential to render the output of the comparator (90) true.

FIG. 3A also shows a second audio signal processing circuit (70B) with inputs (72B and 74B). In an audio system, such as that shown in FIG. 1, each microphone (14, 16 and 18) would, of necessity, be connected to its own audio signal processing circuit. For the audio system shown in FIG. 1, a second audio signal processing circuit (70B) would be connected to a second direction-sensitive microphone. The functional elements shown within the broken line of FIG. 3A and identified by reference numeral 70A are repeated within the signal processing circuit identified by reference numeral (70B).

As set forth above, the output of the first preamplifier stage (76) is also processed and is coupled to a gain fader stage (80A) which is a simple gain stage, the output level of which can be varied by the user to adjust the relative gain applied to the different microphones used in the sound system shown in FIG. 1. The gain stage (80A) is a variable gain stage and simply provides a familiar fader level control for each microphone.

The output of the gain fader stage (80A) is subsequently processed by a bandpass equalization stage (94) to emphasize speech-band frequency signals such that the circuitry responds to speech and not extraneous room noises.. The bandpass equalization stage (94) output is rectified and filtered to produce a near-DC signal. This near-DC signal is then fed to hysteresis gain stage (101A). This stage adds 6 dB of gain to this signal to give a 6-dB advantage to any microphone which is ON. This eliminates any indecision of selecting between two microphones with similar levels. This circuit is also described in the Julstrom patent. This scaled near-DC signal is fed to a sensing diode circuit (98). Output signals from the rectification and filter stages (96A and 96B)

and the hysteresis gain stage (101A and 101B) that appear on line (99A and 99B), are a processed version of the audio input signals detected at the front, or first, cardioid microphone element (54).

With respect to audio signal processing circuit (70B), it is receiving signals from another microphone, processing them identically, and producing corresponding signals on its output line (99B) which signals are coupled to another sensing diode circuit (100).

Sensing diode circuits (98 and 100) are precision rectifier circuits, to greatly reduce the 0.3 to 0.7 volt drop associated with a simple diode. The "anodes" of these circuits are coupled to ground (104) through a resistance (106). At all times, at least one of the sensing diode circuits will be conducting. At any given instant, the channel with the highest input level, as represented by the scaled DC levels (99A, 99B) will conduct.

In the event that signals on output lines (99A and 99B) vary in accordance with each other, indicating that both channels are "hearing" the same signal, only one of the two sensing diodes circuits (98) and (100) will become forward biased. The other channel's signal level will be effectively "shadowed" by the higher signal, and its sensing diode circuit will not conduct. The voltage differential across the forward biased diode is sensed by a comparator stage (102 and 104), the output of which indicates that the audio signal it is receiving exceeds the audio signal input to the other microphone.

Inasmuch as one diode circuit (98 or 100) will turn on when scaled signals on output lines (99A and 99B) are greater than the other, the circuitry implemented with sensing diode circuit (98) and comparator (102) and sensing diode circuit (104) and comparator (104) act as a comparison circuit that produces an output that identifies which of the microphone signals is greatest or maximum at any instant.

With respect to the output of the differential amplifier or comparator 102, its output will go "true" on output line (106) if sensing diode circuit (98) is forward biased. Sensing diode circuit (98) will become forward biased only if the voltage on bus 110 is less than the voltage from the audio signal processing circuit 70A on line 97A. The signal on bus 110 can be considered a max signal corresponding to the greater amplitude signal of the front electrical signals output from each direction-sensitive microphone. Conversely, sensing diode circuit (100) will become forward biased only if the signal on line (97B) is greater than the voltage level on the bus 110, hereafter the "max bus."

Outputs from the comparators (102 and 104) are used to gate audio switches (112 and 114) via the AND gates (122A and 122B) and the hold-up circuits (123A and 123B). The audio signals from the audio signal processing circuit (70A) and the max bus (110) and its associated circuitry (80A, 94A, 96A, 98 and 102) effectively act to gate audio signals to an output (120) only if two conditions are satisfied: the audio must originate from in front of the microphone, as indicated by a ratio of front-element level to rear-element level, and determined by the audio signal processing circuitry (70A) AND the signal from the same microphone must be the largest audio signal detected by all of the microphones, as determined by the amplitude processing circuitry (80A, 94A, 96A and 98 and 102).

Audio signals on line (77A and 77B), which are output from the channel fader stages (80A and 80B) are substantially the audio signals detected at the front cardioid microphone element of microphone (50). The switches (112 and 114) are prevented from going to an ON state unless the outputs from the audio signal processing circuits (70A and 70B) are themselves true. Output signals (92A and 92B) are logically "AND"ed (122A and 122B) with the outputs from the comparative circuits (102 and 104) to provide the gate or enable signal for the switches (112 and 114) through the hold-up circuits (123A and 123B). As the "AND"ed output signals (122A and 122B) are very impulsive, due to the impulsive nature of speech, hold-up circuits extend the signals at lines (122A and 122B) to approximately 0.5 seconds, for two reasons: First, the hold-up circuit bridges gaps in speech so that the microphone stays ON, and second, the hold-up circuit allows several microphones to turn ON simultaneously for several talkers. This is discussed in the Julstrom patent.

Those skilled in the art will recognize that the signal processing shown in the apparatus of FIG. 3A could be accomplished using digital signal processing techniques.

Figure 3B:
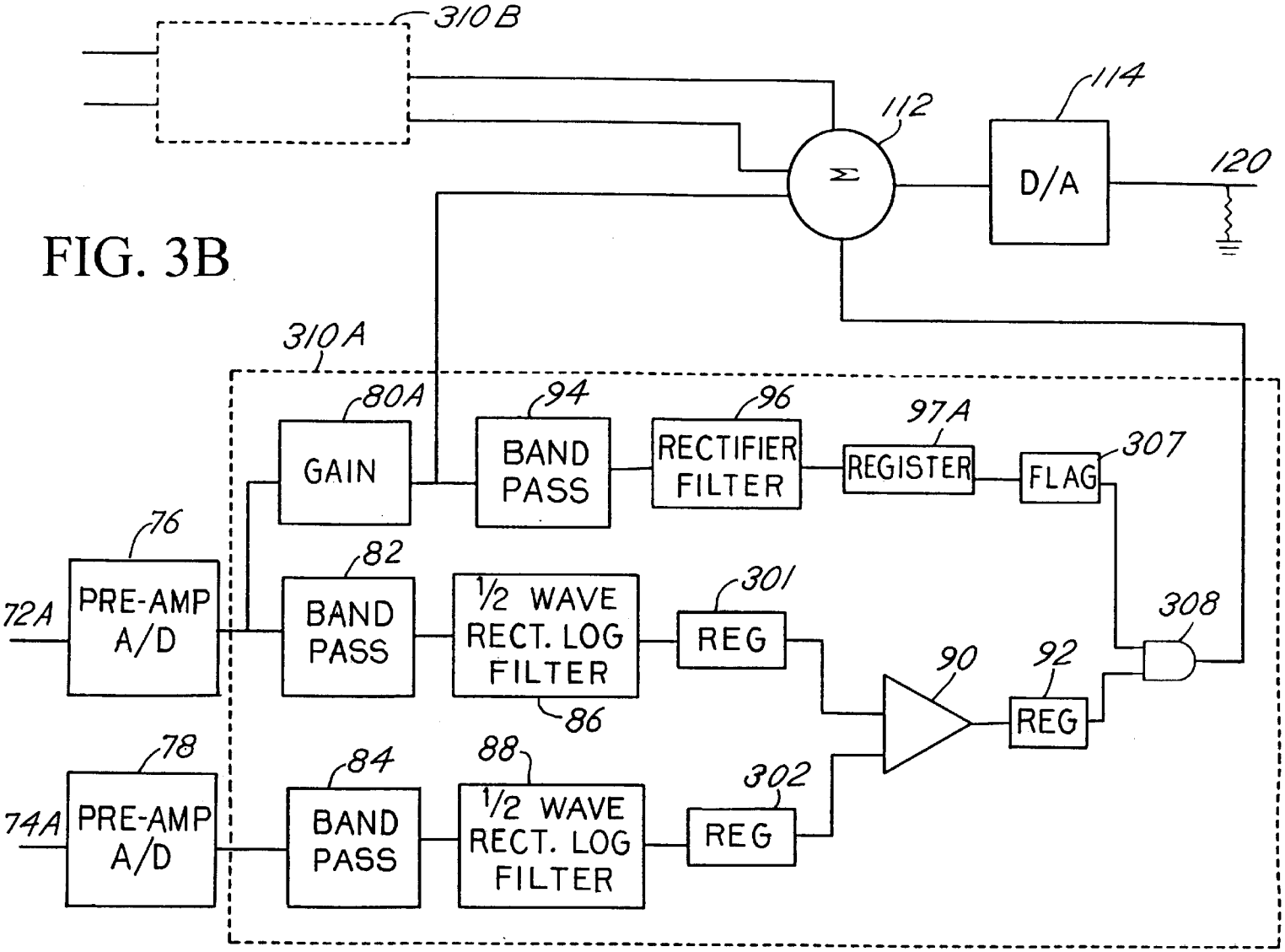
FIG. 3B shows an alternate implementation of the invention and the functional elements of a digital signal processor implementation thereof.

Referring to FIG. 3B, there is shown a functional block diagram of digital signal processor implementing the aforementioned processes, albeit in a digital domain.

FIG. 3B could be implemented using a digital signal processor, a microcontroller, a microprocessor, or other digital technology.

With respect to FIG. 3B, input signals to a digital signal processor (310A) are received at input port (72A and 74A). Both of these signals are preamplified and converted to digital signals by the preamplifier and analog-to-digital (A/D) converter stages (76 and 78) and then fed into a digital signal processor (DSP) for subsequent processing. The output of the A/D converters can be either serial or parallel streams of data.

The digital representations of the signals from the front microphone element (54) and the rear element (52) are then both bandpass equalized (82 and 84), rectified, converted to logarithmic signals, and then digitally filtered (86 and 88) to produce two numbers in two registers (301 and 302), each representing the envelope of the signals picked up from each cardioid microphone element at any point in time. These two numbers are compared (90) to each other on a sample-by-sample, or on a sub-sampled basis if the amplitude from the front element (54) exceeds that from the rear element (52) by some predetermined amount. If the amplitude from the front element (54) exceeds that from the rear element (52) by this amount, a decision is made that a talker is within the acceptance angle of the microphone and a flag is set in register (92) indicating that this criterion has been met.

The audio signal received from the front microphone element (54) is also processed by a gain setting routine (80A), which increases or decreases the effective data amplitude based on input from a user-adjustable control. This scaled signal is then digitally bandpass filtered (94) as in the preferred embodiment, and then it is rectified and filtered (96), to formulate what is a near-DC representation of the audio signals detected by the front microphone element (54); this representation is stored in a register (97A). This register is then tested against all of the other channels' registers (97B) as set forth above, to compare the output of the first microphone elements, first or front directional element to that output from other microphones. The channel's register that is highest for a given sampling cycle "wins" the max bus comparison, and a comparison flag (307) is set to true for that channel. The comparison flag (307) and the register (92) are then logically "AND"ed (308) together. If this condition is true, then the audio data from the output of gain routine (80A) is routed to the adder stage (112) where it is added to the other channels' signals. From here, the data is sent to the digital-to-analog (D/A) converter (114) and converted back to an analog output signal (120). The aforementioned routines describe one channel (310A), and these routines can be duplicated for the second channel (310B).

Figure 3C:
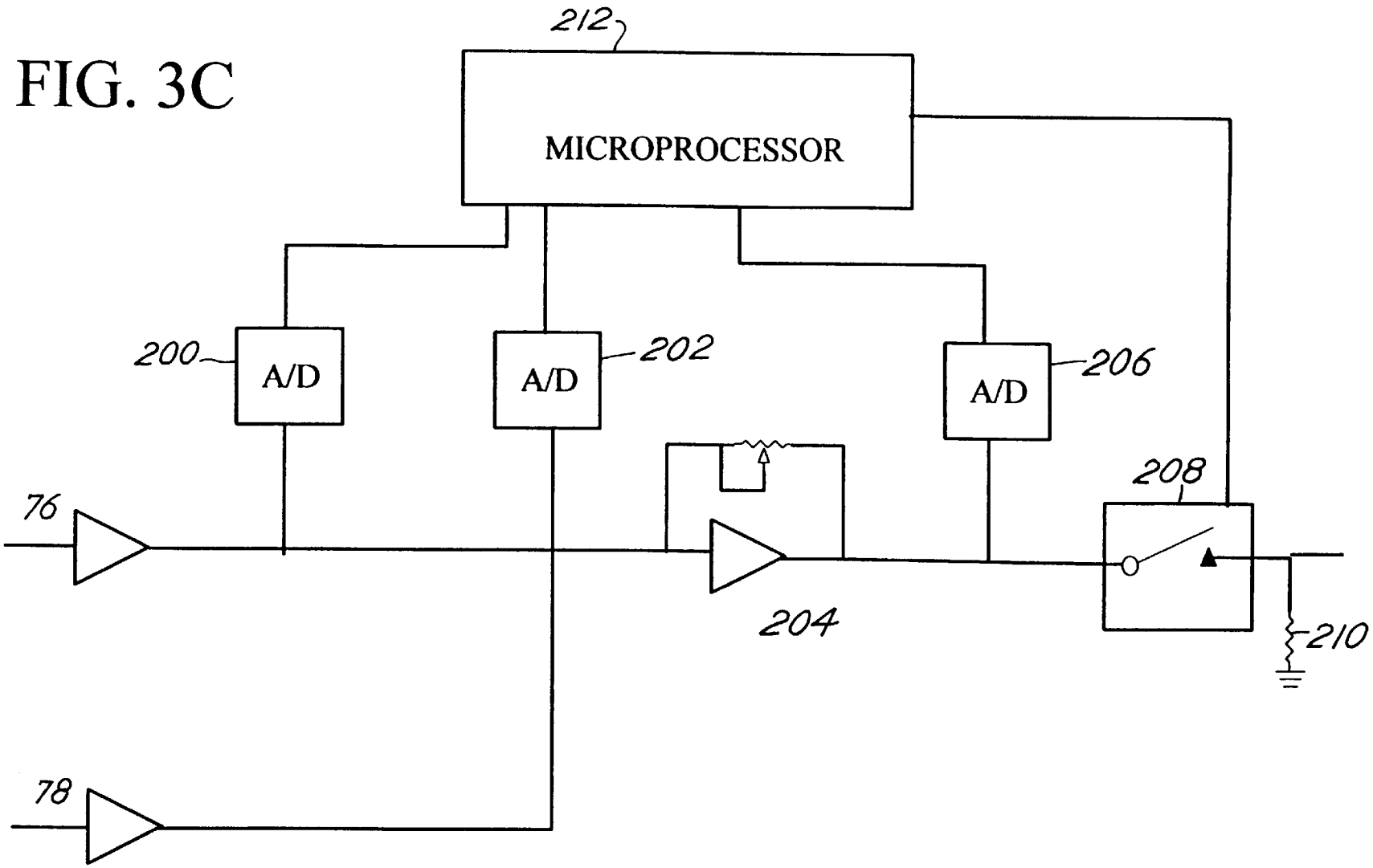
FIG. 3C shows an alternate implementation of the invention and the functional elements of a microprocessor implementation thereof.

FIG. 3C shows yet another alternate embodiment of the invention using a microprocessor (212) to make gating decisions, but using analog circuitry to pass the audio signal. In FIG. 3C, the comparison of microphone output levels is after the microphone preamplifiers (76 and 78) via A/D conversion (200 and 202) to the microprocessor. The signal from the front microphone cartridge (54) is passed through the preamplifier (76) and to the fader stage (204). The output from this fader stage is fed into a third A/D converter (206), which provides the data for the max bus routines. The microprocessor sends a gating control signal to audio switch (208) which feeds the audio signal to line (210) for output to subsequent audio device in the system. All of the routines for filtering and decisions are done in similar fashion as the DSP implementation as illustrated in FIG. 33.

Those skilled in the art will recognize that the combination of the direction-sensitive microphones, the outputs of which vary with the angle of incidence of audio signals received by them, are capable of capturing audio signals from sources that are not directly in front of them. As microphones recede from the talker, the talker's voice produces an increasingly weak signal, which the microphone is not able to detect and discriminate against background noise. An adjacent microphone, another second microphone adjacent to a talker, might pick up that talker's voice albeit with less intensity.

The audio signal processing circuits described herein, analyze the output of the direction-sensitive microphones and amplify such outputs only if the output of the microphone front input exceeds that from the rear input by some predetermined amount. If the directional microphone front input level is substantially greater than the rear input level, the microphone is detecting audio that originating within some predetermined angle in front of the microphone.

Subsequent processing of the outputs of all microphones that have, or are detecting, such audio signals are compared to identify which microphone is detecting the strongest signal. The microphone that is detecting the strongest audio signal, and that has an audio signal originating from in front of the direction-sensitive microphone, i.e., greater than 9.5 dB difference between the front and rear inputs, is the microphone most likely to be closest and having the loudest output of the talker.

Accordingly, by this invention, the output of one microphone is identified as having the largest amplitude for a given audio source. The output of the microphone that best hears a source is transmitted to other audio processing equipment, such as a loudspeaker, tapes or other audio distribution equipment.

What is claimed is:

1. A sound system comprising:

a first direction sensitive microphone means having front and rear microphone elements respectively coupled to front and rear output terminals, said first direction-sensitive microphone means for receiving a first acoustic signal at said front microphone element and at said rear microphone element and for producing a front electrical signal at said front output terminal representative of the first acoustic signal detected by said front microphone element and for producing a rear electrical signal at said rear output terminal representative of the first acoustic signal detected by said rear microphone element;

a second direction-sensitive microphone means having front and rear microphone elements respectively coupled to front and rear output terminals, said second direction-sensitive microphone means for receiving a second acoustic signal at said front microphone elements and at said rear microphone element and for producing a front electrical signal at said front output terminal representative of the second acoustic signal detected by said front microphone element and for producing a rear electrical signal at said rear output terminal representative of the second acoustic signal detected by said rear microphone element;

a first audio signal processing means coupled to said front and rear output terminals of said first direction-sensitive microphone means for producing a first microphone control signal that is active when said front electrical signal of said first direction-sensitive microphone means exceeds said rear electrical signal of said first direction-sensitive microphone means by a predetermined amount;

a second audio signal processing means coupled to said front and rear output terminals of said second direction-sensitive microphone means for producing a second microphone control signal that is active when said front electrical signal of said second direction-sensitive microphone means exceeds said rear electrical signal of said second direction-sensitive microphone means by a predetermined amount;

audio signal level comparison means, coupled to said first direction-sensitive microphone means to receive said front electrical signal of said first direction-sensitive microphone means and coupled to said second direction-sensitive microphone means to receive said front electrical signal of said second direction-sensitive microphone means, for determining which of said front electrical signals of said first and second direction-sensitive microphone means is greater in amplitude and for producing a max signal corresponding to the greater amplitude signal of said front electrical signal of said first direction-sensitive microphone means and said second direction-sensitive microphone means and for comparing said max signal to said front electrical signals of said first and second direction-sensitive microphone means and producing a microphone selection signal identifying which of said first and second direction-sensitive microphone means has the larger amplitude front electrical signal;

a first gating means coupled to said audio signal level comparison means to receive said microphone selection signal, and coupled to said first audio signal processing means to receive said first microphone control signal, wherein an audio output signal is produced if the microphone selection signal and the first microphone control signal are both active;

a second gating means coupled to said audio signal level comparison means to receive said microphone selection signal and coupled to said second audio signal processing means to receive said second microphone control signal wherein an audio output signal is produced if the microphone selection signal and the second microphone control signal are both active.

2. The sound system of claim 1 where at least one of said first and second direction-sensitive microphones are comprised of cardioid microphone elements.

3. The sound system of claim 1 where at least one of said first and second direction-sensitive microphones are unidirectional microphones.

4. The sound system of claim 1 where at least one of said first and second direction-sensitive microphones are Shure Brothers Inc. AMS microphones.

5. The sound system of claim 1 where at least one of said first and second audio signal processing means is comprised of an audio preamplifier.

6. The sound system of claim 1 where at least one of said first and second audio signal processing means is comprised of a gain bandpass equalization stage.

7. The sound system of claim 1 where at least one of said first and second audio signal processing means is comprised of a logarithmic rectifier and filter stage.

8. The sound system of claim 1 where at least one of said first and second audio signal processing means is comprised of a half wave logarithmic rectifier and filter stage.

9. The sound system of claim 1 where at least one of said first and second audio signal processing means is comprised of a comparator stage.

10. The sound system of claim 1 wherein said audio signal level comparison means is comprised of a bandpass equalization stage.

11. The sound system of claim 1 wherein said audio signal level comparison means is comprised of a rectification and filter stage.

12. The sound system of claim 1 wherein said audio signal level comparison means is comprised of a sensing diode circuit.

13. The sound system of claim 1 wherein said audio signal level comparison means is comprised of a comparator.

14. The sound system of claim 1 wherein said gating means includes an audio switch.

15. The sound system of claim 1 wherein at least one of said first and said second audio signal processing means is comprised of a digital signal processor.

16. The sound system of claim 1 wherein at least one of said first and said second audio signal processing means is comprised of a microprocessor.

17. The sound system of claim 1 wherein said audio signal level comparison means is comprised of a digital signal processor.

18. The sound system of claim 1 wherein said audio signal level comparison means is comprised of a microprocessor.

19. The sound system of claim 1 wherein said gating means is comprised of a digital signal processor.

20. The sound system of claim 1 wherein said gating means is comprised of a microprocessor.

21. A sound system comprising:

a first direction sensitive microphone having a front microphone element coupled to a front output terminal and a rear microphone element coupled to a rear output terminal wherein the first microphone receives an acoustic signal at the front and rear elements and wherein the first microphone produces a first front electrical signal corresponding to an amplitude of the acoustic signal detected at the front element and a first rear electrical signal corresponding to an amplitude of the acoustic signal detected at the rear element;

a second direction sensitive microphone having a front microphone element coupled to a front output terminal and a rear microphone element coupled to a rear output terminal wherein the second microphone receives the acoustic signal at the front and rear elements and wherein the second microphone produces a second front electrical signal corresponding to an amplitude of the acoustic signal detected at the front element and a second rear electrical signal corresponding to an amplitude of the acoustic signal detected at the rear element;

a first audio signal processor coupled to the front and rear output terminals of the first microphone wherein the first audio signal processor produces a first control signal that is active when the amplitude of the first front electrical signal exceeds the amplitude of the first rear electrical signal by a predetermined amount;

a second audio signal processor coupled to the front and rear output terminals of the second microphone wherein the second audio signal processor produces a second control signal that is active when the amplitude of the second front electrical signal exceeds the amplitude of the second rear electrical signal by a predetermined amount;

a max signal corresponding to the front electrical signal of the first and second microphones that has the greater amplitude;

an audio comparison circuit coupled to the first and second microphones, for receiving the first and second front electrical signals wherein the audio comparison circuit compares the max signal to the first and second front electrical signals and produces a microphone selection signal that identifies at any instant the front electrical signal having the larger amplitude;

a first gate coupled to the audio comparison circuit for receiving the microphone selection signal, and coupled to the first audio signal processor for receiving the first control signal, wherein an audio output signal is produced if the microphone selection signal and the first control signal are active;

a second gate coupled to the audio comparison circuit for receiving the microphone selection signal, and coupled to the second audio signal processor for receiving the second control signal, wherein an audio output signal is produced if the microphone selection signal and the second control signal are active.

* * * * *

UNITED STATES PATENT AND TRADEMARK OFFICE

CERTIFICATE OF CORRECTION

PATENT NO : 6,137,887

DATED : October 24, 2000

INVENTOR(S) : Anderson

It is certified that error appears in the above-identified patent and that said Letters Patent is hereby corrected as shown below:

The errors appear in the patent at:

col. 2, line 29, "employs multiple unidirectional microphones per channel" and should read – employs multiple uni-directional microphones per channel" – col. 2, line 45, "unidirectional microphone employed in the preferred" and should read –uni-directional microphone employed in the preferred –.

col. 9, line 20, "DSP implementation as illustrated in FIG. 33." and should read – DSP implementation as illustrated in FIG. 3B. –

Signed and Sealed this

Fifteenth Day of May, 2001

*Attest:*

NICHOLAS P. GODICI

*Attesting Officer*

*Acting Director of the United States Patent and Trademark Office*